US006203153B1

(12) United States Patent
Barton

(10) Patent No.: US 6,203,153 B1
(45) **Date of Patent: *Mar. 20, 2001**

(54) METHOD AND APPARATUS FOR PRINTING ON GELATIN COATED MEDIA

(75) Inventor: Earl Lewis Barton, Corvallis, OR (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/608,106

(22) Filed: Feb. 28, 1996

(51) Int. Cl.[7] ..... B41J 2/01

(52) U.S. Cl. ..... 347/105

(58) Field of Search ..... 347/105, 102

(56) References Cited

U.S. PATENT DOCUMENTS

| | | | |
|---|---|---|---|
| 3,889,270 | 6/1975 | Hoffmann et al. . | |
| 4,588,315 | 5/1986 | Seto et al. . | |
| 5,116,409 | 5/1992 | Moffatt . | |
| 5,141,599 | 8/1992 | Jahn et al. . | |
| 5,328,748 | 7/1994 | Westfal . | |
| 5,331,001 | 7/1994 | Hamilton . | |
| 5,349,905 | 9/1994 | Taylor et al. . | |
| 5,371,531 | 12/1994 | Rezanka et al. . | |
| 5,373,312 | 12/1994 | Fujioka et al. . | |
| 5,376,958 | 12/1994 | Richtsmeier et al. . | |
| 5,399,039 | 3/1995 | Giles et al. . | |
| 5,428,384 | 6/1995 | Richtsmeier et al. . | |
| 5,436,642 | 7/1995 | Oyamaguchi et al. . | |
| 5,472,789 | 12/1995 | Iqbal et al. . | |
| 5,568,173 * | 10/1996 | Leenders et al. | 347/96 |

FOREIGN PATENT DOCUMENTS

| | | | |
|---|---|---|---|
| 0445327A1 | 9/1991 | (EP) . | |
| 0600245A1 | 6/1994 | (EP) . | |
| 2254585 | 10/1992 | (GB) | B41J/2/17 |
| 56-148583 | 11/1981 | (JP) | B41M/5/00 |
| 61-29581 * | 2/1986 | (JP) . | |
| 61-029581 | 2/1986 | (JP) | B41M/5/00 |
| 61-172787 | 8/1986 | (JP) | B41M/5/00 |
| 2-235750 * | 9/1990 | (JP) . | |
| 2235750 * | 9/1990 | (JP) | 347/102 |
| 6239013 | 8/1994 | (JP) | B41M/5/00 |

OTHER PUBLICATIONS

McCormick–Goodhart, Mark H. "Moisture–Content Isolines of Gelatin and the Implications for Accelerated Aging Tests and Long–Term Storage of Photographic Materials." *Journal of Imaging Science and Technology*, vol. 39, No. 2, Mar./Apr. 1995, Section I.B., p. 55.*

"Theory of photographic Processes", P.I. Rose (author), 4th Edition, Eastman Kodak, Chapter 2, Section B, 1977.*

Journal Of Imaging Science and Technology, Mark H. McCormick–Goodhart, Moisture–Content Isolines Of Gelatin and The Implications For Accelerated Aging Tests And Long–Term Storage Of Photographic Materials, vol. 39, No. 2, Mar./Apr. 1995, pp 157–162.

* cited by examiner

*Primary Examiner*—John Barlow
*Assistant Examiner*—Raquel Yvette Gordon
(74) *Attorney, Agent, or Firm*—Kevin B. Sullivan

(57) ABSTRACT

The present invention is an ink jet printer for providing high quality output images. The printer includes an ink ejection device for ejecting ink onto a coated media. The coated media has a surface layer that has an ink absorption property that is temperature dependent. Also included is a heating device for heating the coated media to control the absorption of ink into the surface layer of the coated media.

11 Claims, 1 Drawing Sheet

METHOD AND APPARATUS FOR PRINTING ON GELATIN COATED MEDIA

BACKGROUND OF THE INVENTION

The present invention relates to a method and apparatus for ink jet printing on a gelatin coated media. More particularly, the present invention relates to a method and apparatus for heating the gelatin coated media to control absorption of ink into a gelatin surface layer of the media.

Ink jet printers operate by expelling ink from a plurality of nozzles. In the case of thermal ink jet printers one or more resistors are associated with each of the plurality of nozzles. The resistors when energized vaporize ink to produce a rapidly expanding bubble to expel a selected volume of ink from a selected nozzle toward the print media.

The nozzles, resistors and ink together form a print cartridge. The print cartridge is moved relative to the print media as ink is expelled from the nozzles to form images on the media. Frequently, the print cartridge is mounted in a print carriage that is moved or scanned repeatedly across the print media width as the print media is advanced to form the output image.

In the case of color printing, the print cartridge contains more than one color ink. In the case of four color printing the print cartridge usually contains cyan, magenta, yellow and black inks. Each of the colored inks within the print cartridge have associated nozzles. By selectively energizing resistors as the print cartridge is moved across the media color images are formed on the print media.

The accuracy and consistency in which the printer delivers ink droplets to the print media as well as the interaction of the ink with the media effects the output image visual quality. The printers ability to deliver droplets of ink is generally related to the printer resolution. The resolution of a printer is related to the size of an individual picture element formed by each individual droplet of ink as well as the printers ability to correctly position each of these individual picture elements on the media surface.

In addition, attempts have been made to improve the output image quality by improvements to the interaction of the ink with the output media. Problems that are associated with the interaction of ink with the media include ink bleed, ink coalescence on the media surface, and cockling or warping of the media resulting from ink saturation. The ink used in thermal ink jet printing is an aqueous ink having a liquid base. When the liquid ink is deposited on wood based papers, it absorbs into the cellulose fibers and causes the fibers to swell. As the cellulose fibers swell, they generate localized expansions, which in turn, causes the paper to warp uncontrollably in these regions. This phenomena called paper cockle can cause a degradation of print quality due to uncontrolled orifice to media spacing, and can cause the printed output to have a low quality appearance due to the wrinkled paper.

One solution that has been used to eliminate or reduce cockling has been to dry the ink rapidly after it is printed. High output heaters are usually required to accelerate the ink drying process. There are several problems associated with using high output heaters to accelerate ink drying. Too much heat can cause polyester media to wrinkle and cellulose based media to turn yellow. In addition, excess heat can overheat the print cartridges, resulting in larger drops of ink being expelled during print operations thereby increasing the cost per copy. If the print cartridges become too hot, the cartridges will stop working. Excessive heat within the printer housing can cause melting and deforming of plastic components and shorten the life of electronic components.

The use of high output heaters in printers has sometimes produced additional problems such as buckling problems that can require the additional techniques such as the use of pre-heaters for drying the print medium under high humidity conditions. These pre-heaters have been used to dry the medium before reaching the print zone to prevent uneven shrinkage of the medium which can occur if not pre-heated. Uneven shrinkage of the medium results because of the localized nature of the high output heating which produces uneven heating which can cause buckling of the medium. Buckling of the print medium produces uneven spacing between the medium and print orifices which can effect the output image quality. In extreme cases if the output medium contacts the print orifices smearing can result.

As mentioned previously, the use of high output heaters can produce additional problems such as excessive heat within the printer housing. To prevent excessive overheating of the print nozzles resulting from the high output heaters one or more fans have been used for cooling. The use of cooling fans in printers having output heaters adds to the cost of the printer as well as the size and weight, and manufacturability which is undesirable.

There is a present need for relatively low cost printers that are capable of providing high quality output images. These printers should minimize ink running on the media surface as well as minimize ink bleed. In addition, the output images should have relatively fast dry times.

SUMMARY OF THE INVENTION

The present invention is a method and apparatus for ink jet printing. The ink jet printer includes an ink ejection device for ejecting ink onto a coated media. The coated media has a surface layer having ink absorption properties that are temperature dependent. Also included is a heating device for heating the coated media to control the absorption of ink into the surface layer of the coated media.

In one preferred embodiment, the surface layer is a gelatin layer. In this preferred embodiment the heating device is a heater for heating the surface layer to a glass transition range of the gelatin surface layer. In one preferred embodiment the glass transition temperature range of the gelatin surface layer is a range from 30 to 50 degrees Celsius.

DETAILED DESCRIPTION OF THE PREFERRED EMBODIMENT

Figure 1:
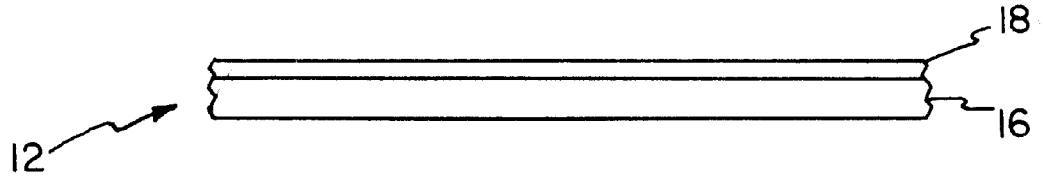
FIG. 1 is a representation of the coated media which is used with the printer of the present invention shown in cross section.
Figure 2:
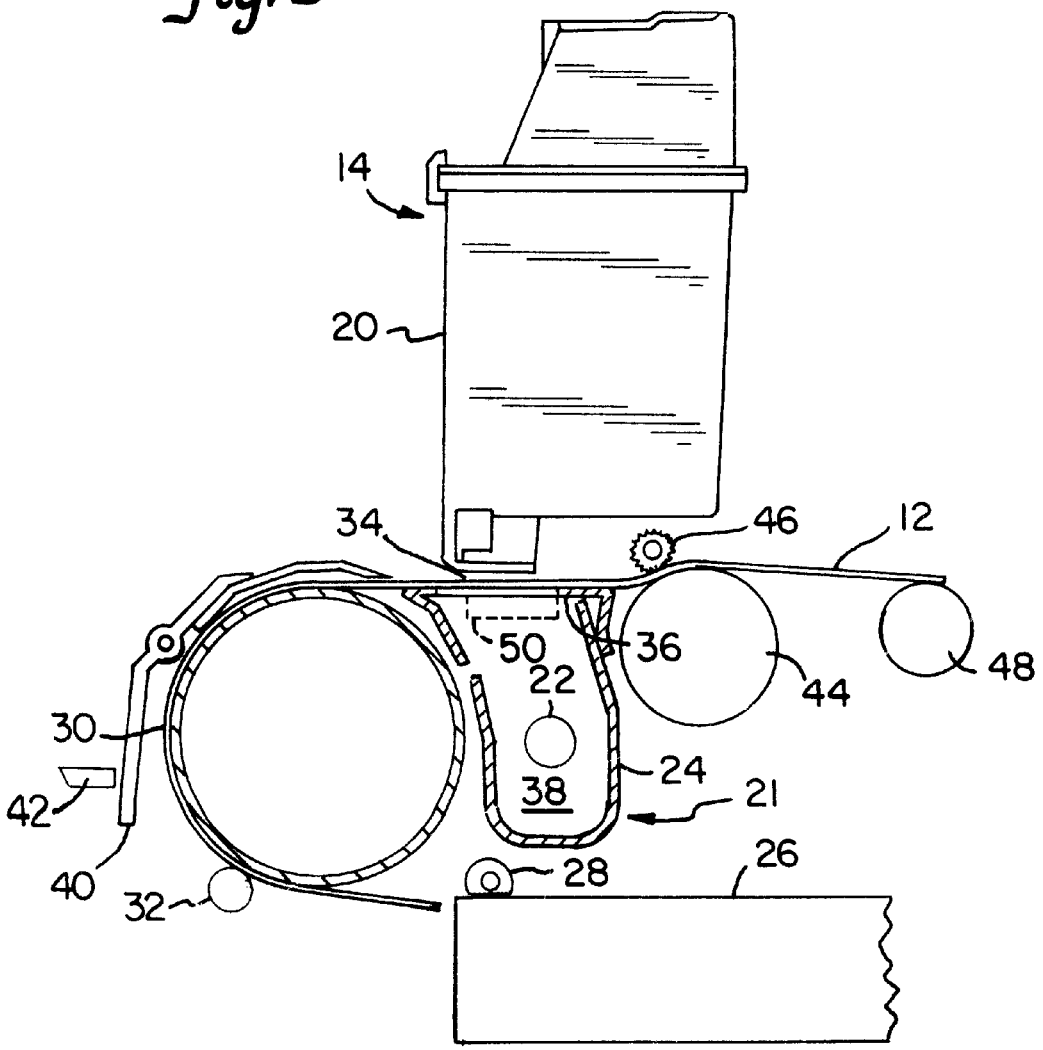
FIG. 2 is a simplified schematic diagram of an ink jet printer of the present invention for printing on coated media.

FIG. 1 represents the coated media 12 for use with the ink jet printer 14 of the present invention shown in FIG. 2. The coated media 12 includes a base layer 16 and a surface layer 18. The cross-section of the coated media 12 shown in FIG. 1 is a representation and is therefore not drawn to scale. The base layer 16 is a conventional base layer such as a polyethylene coated base layer. The surface layer is suitable for application to the base layer 16 and has a temperature dependent ink absorption property. The surface layer 18 has a certain ability to absorb ink at a first temperature and a different ability of absorbing ink at a second temperature.

In one preferred embodiment the surface layer 18 is a gelatin based surface layer that is manufactured from connective tissue obtained from mammals. Gelatin coated media is known and described for example in U.S. Pat. No. 5,141,599 to Jahn et al incorporated herein by reference.

FIG. 2 is the ink jet printer 14 of the present invention which when used with the coated media 12 previously described provides output images of high image quality. The ink jet printer 14 includes a print cartridge 20 and a means for controlling the print cartridge 20 in order to direct ink from the cartridge 20 onto the surface layer 18 of the print media 12.

The printer 14 of the present invention further includes a mechanism for advancing the print media 12 and a heater 21. The heater 21 which is an important aspect of the present invention is used to heat the print media to control the absorption of ink into the surface layer 18 of the print media. The heater 21 in one embodiment is a radiant heater comprising an electric bulb 22 for providing a heat source and a reflector 24 for directing or focusing heat produced to the print media 12. The means for controlling the printhead 20 is a conventional controller such as the printhead controller described in the commonly assigned Patent entitled "Staggered Pens In Color Thermal Ink Jet Printer" , filed May 1, 1992, U.S. Pat. No. 5,376,958, by B. W. Richtsmeier, incorporated herein by reference.

The means for handling the print medium 12 can be any conventional method. For example as shown in the present embodiment the print medium 12 is supplied in sheet form from a tray 26. A pickup roller 28 is employed to advance the print medium 12 from the tray 26 into engagement between drive roller 30 and idler roller 32. Once the print medium 12 has been advanced into the nip between the drive roller 30 and idler rollers 32, it is advanced further by the rotation of drive roller 30.

The print medium 12 is fed to a print zone 34 beneath the area traversed by the print cartridge 20 and over a print screen 36 which provides a means of supporting the print medium 12 at the print position. The print medium 12 is fed to the print zone 34 with the surface layer 18 facing the print cartridge 20. The screen 36 further allows efficient transfer of radiant and convective energy from the print heater cavity 38 to the print medium 12 as well as providing a safety barrier by limiting access inside of the reflector 24.

While the print medium 12 is advanced, a movable drive plate 40 is lifted by a cam 42 actuated by the printhead carriage. Once the print medium 12 reaches the print zone 34, the drive plate 40 is dropped, holding the medium against the screen 36, and allowing minimum spacing between the print nozzles of the ink jet print cartridge 20 and the medium.

In one embodiment the heater is a halogen quartz bulb 24 disposed longitudinally under the print zone 34. The quartz bulb 24 provides a source of thermal radiation and convective energy to the print medium 12. The reflector 22 helps to direct both the radiant energy and convective energy toward the print zone.

An exit roller 44, starwheel 46 and output stacking roller 48 work in conjunction with the drive roller 30 to advance and eject the print medium 12. A gear train (not shown) for driving the gears is arranged such that the exit roller drives the print medium 12 slightly faster than the drive roller 30 so that the print medium 12 is under some tension once engaged by the exit roller 44. The frictional force between the print medium and the respective rollers is somewhat less than the tensile strength of the print medium so there is some slippage of the print medium on the rollers. The tension facilitates good print quality keeping the print medium 12 flat under the print zone 34.

The heater 21 is selected to provide a sufficient amount of heat energy to the advancing print media 12 to achieve a temperature of the surface layer 18 of the print media within a selected temperature range. The heater 21 heats the base layer 16 of the print media 12. The temperature of the surface layer 18 which is in contact with the base layer 16 is then warmed primarily by conductive heating.

The temperature range is selected based on the particular media coating composition and the absorption properties of the particular media. In one preferred embodiment a 20 watt heater is used to achieve a print media temperature in a range of 30 to 50 degrees Celsius. Heating a gelatin coated media to a range from 30 to 50 degrees Celsius increases the absorbency of the surface layer 18 of the coated media 12 thereby preventing bleeding or running of the aqueous inks.

Two inks made from water-soluble dyes, when printed next to each other tend to bleed. Bleed refers to the mutual dye diffusion that takes place when one ink dot is placed next to another on the print medium. If the two dots contain dyes of different hues, then the diffusion phenomenon is called color bleed, and reduces the quality of the output image.

The gelatin crystallites act as cross-links which can orient in the plane of the surface layer forming a partly crystalline structure. In the preferred embodiment the predominate crosslinks are collegen which are effected by heat. Heating the gelatin surface layer to a glass transition temperature range tends to break the cross-links in the crystalline structure softening the collagen fold structure and allowing the gelatin surface layer to absorb aqueous inks. The glass transition temperature range in general will be dependent upon the specific composition of the gelatin as well as the moisture-content of the gelatin, see, "Moisture-content Isolines of Gelatin and the Implications for Accelerated Aging Tests and Long-Term Storage of Photographic Materials" by Mark H. McCormick-Goodhart, Journal of Imaging Science and Technology, Vol. 39, Number 2, March/April 1995.

It is believed that the improved absorption of aqueous inks is primarily due to mechanical changes in the gelatin surface structure as the structure is heated to a glass transition temperature range. At the glass transition temperature range the collagen folds relax to increase the surface area of the gelatin surface area. This increase in surface area effectively increases the amount of ink which can be applied to the media surface without running or bleeding. In addition, the increase in surface area of the media increases the surface area of the ink which improves evaporation thereby improving dry time. Therefore, the surface layer 18 can be a material other than gelatin which exhibits a temperature dependent change in the surface structure which increases the ink absorbency and shortens dry time of the media 12.

Inks used by the ink jet printer 14 of the present invention can be a variety of conventional inks such as described in U.S. Pat. No. 5,116,409 entitled "Bleed Aleviation In Ink Jet Inks" to Moffatt, filed Apr. 17, 1991, assigned to assignee of the present invention, incorporated herein by reference. These inks generally include water, some form of water soluable dye, surfactants, glycol and solvents. These inks are compatible with gelatin coatings and are readily absorbed by the gelatin as the collagen surface structure is softened.

An alternative embodiment of the heater of the present invention is to replace the radiant heater shown in FIG. 2 with a strip heater 50 shown dotted in FIG. 2. The strip heater 50 is a conventional strip heater and is positioned proximate the print zone 34. In the preferred embodiment the strip heater 50 is electrically operated and heats the media 12 by convection and conduction to a range from 30 to 50 degrees Celsius.

The strip heater 50 has a platen surface facing the print zone 34 which supports the print media 12 as the media 12 passes through the print zone 34. The platen surface heats the media 12 to the glass transition temperature range as the media passes through the print zone 34. The platen surface should be smooth to maximize the surface area of engagement with the media 12 to more efficiently heat the media.

In an alternative embodiment the strip heater is replaced by utilizing the printer zone internal heat producing elements to provide heat for heating the screen or platen in the print zone 34. For example, motor driver integrated circuits and heat dissipating elements in the power supply can be mounted to provide heat to a platen for heating the media in the print zone 34 for increasing the absorption of ink into the surface layer 18 of the print media 12.

In contrast to the heaters that have been used in the past which make use of high heat for evaporating aqueous inks the heater used in the present invention makes use of low temperatures to control the absorption of aqueous based inks into a gelatin coated media. The use of a low temperature heater improves the absorption of ink tending to reduce in bleed and ink run thereby improving output image quality. The heat applied to the media alters the media to increases ink absorbency in contrast to previously used heaters that have been used to evaporate water contained in water based aqueous inks.

Furthermore, the used of a low power heater as is use in the present invention increases the absorption of ink into the media and improves dry time without the complexity and the drawbacks associated with the high output heaters. For example, the low output heater is less likely to cause wrinkling or yellowing of the media. In addition, the low output heater used in the present invention has less tendency to damage printer components such as plastic or the ink cartridge itself.

What is claimed is:

1. An ink jet printer for printing on a coated media, the ink jet printer comprising:

an ink ejection device for ejecting ink onto the coated media, the coated media having a base layer of a non-gelatin material and a surface layer formed of gelatin, the gelatin surface layer exhibiting an increase in surface area dependent upon temperature of the gelatin surface layer of the coated media, the increase in surface area of the gelatin surface layer absorbing an increased amount of the ejected ink; and a heating device associated with the ink jet printer and located in proximity to the coated media, the heating device emitting heat while the ink ejection device ejects ink onto the coated media, the heating device heating the gelatin surface layer to a glass transition temperature range of 30 to 50 degrees Celsius to control the surface area of the gelatin surface layer and thereby penetration of ink into the gelatin surface layer of the coated media.

2. The ink jet printer of claim 1 wherein the heating device is a radiant heater.

3. The ink jet printer of claim 1 wherein the heating device is a heated platen.

4. The ink jet printer of claim 1 wherein the heating device is a platen that is heated by printer zone heat producing elements.

5. The ink jet printer of claim 1 wherein an increase in temperature of the selected heat causes the increase in the surface area of the gelatin surface layer with a resulting increase in the penetration of the ejected ink into the gelatin surface layer of the coated media.

6. A method for controlling the penetration of ink jetted from an ink jet printer onto a gelatin coated media, the method comprising:

printing ink onto a coated media using an ink jet printing device, the coated media having a base layer of a non-gelatin material and a surface layer formed of gelatin, the gelatin surface layer exhibiting an increase in surface area dependent upon temperature of the gelatin surface layer of the coated media, with the increase in surface area of the gelatin surface layer absorbing an increased amount of printed ink;

heating the gelatin surface layer of the coated media with a heating device to a glass transition temperature range from 30 to 50 degrees Celsius while printing ink onto the coated media; and effecting changes in the surface area of the gelatin surface layer to control penetration of printed ink into the gelatin surface layer.

7. The method for controlling ink penetration in a coated media of claim 6 wherein heating the gelatin surface layer is performed by a radiant heater.

8. The method for controlling ink penetration in a coated media of claim 6 wherein heating the gelatin surface layer is performed by a platen heater positioned proximate the gelatin surface layer.

9. The method for controlling ink penetration in a coated media of claim 6 wherein an increase in temperature of the selected heat causes the increase in the surface area of the gelatin surface layer with a resulting increase in the penetration of printed ink into the gelatin surface layer of the coated media.

10. An ink jet printer for printing on a gelatin coated media, the gelatin coated media having a glass transition temperature range where the gelatin coated media has a surface area and an ink absorbency that increases dependent upon temperature, the ink jet printer comprising:

an ink ejection device for ejecting ink onto gelatin coated media, the coated media having a base layer of a non-gelatin material and a surface layer formed of gelatin, the gelatin surface layer having the glass transition temperature range wherein the gelatin surface layer exhibits an increase in surface area dependent upon temperature of the gelatin surface layer, with the increase in surface area of the gelatin surface layer absorbing an increased amount of the ejected ink; and a heating device associated with the ink jet printer and located in proximity to the gelatin coated media, the heating device emitting heat while the ink ejection device ejects ink onto the coated media, the heating device heating the gelatin surface layer to a glass transition temperature range from 30 to 50 degrees Celsius to control the surface area of the gelatin surface layer and thereby gelatin surface layer penetration of the ejected ink; and wherein the ink jet printer has printer zone internal heat producing elements and wherein the heating device comprises the printer zone internal heat producing elements.

11. The ink jet printer of claim 10 wherein an increase in temperature of the selected heat causes the increase in the surface area of the gelatin surface layer with a resulting increase in gelatin surface layer penetration of the ejected ink.

* * * * *